US007485830B2

(12) United States Patent
Wang

(10) Patent No.: US 7,485,830 B2
(45) Date of Patent: Feb. 3, 2009

(54) AUTOMATIC COOKING DEVICE

(75) Inventor: Tsanyao Jeremy Wang, Taoyuan (TW)

(73) Assignee: Volks Robot Taiwan Corp., Lujhu Township (TW)

( * ) Notice: Subject to any disclaimer, the term of this patent is extended or adjusted under 35 U.S.C. 154(b) by 122 days.

(21) Appl. No.: 11/538,086

(22) Filed: Oct. 3, 2006

(65) Prior Publication Data

US 2008/0099462 A1 May 1, 2008

(51) Int. Cl.
*A47J 37/04* (2006.01)
*A47J 37/12* (2006.01)

(52) U.S. Cl. ..... 219/429; 219/201; 219/385; 219/389; 99/326; 99/329 P; 99/348; 99/339; 220/476; 220/478

(58) Field of Classification Search ..... None
See application file for complete search history.

(56) References Cited

U.S. PATENT DOCUMENTS 3,095,326 A * 6/1963 Green et al. ..... 99/352
4,173,925 A * 11/1979 Leon ..... 99/348
5,386,102 A * 1/1995 Takikawa et al. ..... 99/348
6,843,166 B1 * 1/2005 Li ..... 99/348
6,966,691 B2 * 11/2005 Brunswick et al. ..... 366/207
7,411,159 B2 * 8/2008 Oosterling ..... 219/389
2005/0193901 A1 * 9/2005 Buehler ..... 99/468

* cited by examiner

*Primary Examiner*—Joseph M Pelham
(74) *Attorney, Agent, or Firm*—Schmeiser, Olsen & Watts

(57) ABSTRACT

An automatic cooking device of the present invention comprises a rotating body and a cooking vessel that can regulate and control cooking processes. The rotating body is connected to a fixed structure, and the cooking vessel is attached on top of the rotating body. The automatic cooking device further utilizes integrated rotating devices, the cooking vessel and several driving motors to perform 3-dimensional movement including rotation, vibration, expanding and contracting motions, swinging or a combination of these motions. The automatic cooking device of the present invention is designed in such that it is simple to use and cost effective yet imparts meals cooked therein with the taste and flavor of food cooked traditionally. In other words, the automatic cooking device can cook various meals rapidly without impairing in quality of taste and flavor of the food. The automatic cooking device also can be used to prepare different meals.

8 Claims, 2 Drawing Sheets

AUTOMATIC COOKING DEVICE

BACKGROUND OF THE INVENTION

1. Field of Invention

The present invention relates an improved cooking device, particularly, the present invention relates an automatic cooking device for general purpose heating, cooking in a house, restaurants and the like.

2. Description of the Related Art

The cooking devices with digital cooking programs control the cooking processes according to the food to be prepared become increasing popular in our daily life. Most of the prior art are designed to operate the cooking programs with only hot air or with only steam, or with a combination of hot air and steam at various temperatures and different time settings. However, the setting and use of such cooking devices requires special knowledge, particularly for cooking processes in which different cooking media are used for various periods of time at different temperatures. For most of people, those high-tech cooking devices are inconvenient and difficult to be operated.

Secondly, those cooking devices are not suitable to prepare food in the hot oil, such as stir-fry food, a common dish in the Chinese cuisine. As a matter of fact, the conventional cooking devices are restricted in its cooking programs in respect to certain type of food to be cooked, most of Asian cuisine cannot be prepared through hot air or steam, as a result, the conventional cooking devices cannot prepare various types of food.

Further, the setting of the cooking programs of those cooking devices known from the prior art is very time consuming, in particular if there are a number of such cooking devices in a large kitchen.

Moreover, most of the conventional computerized cooking devices are large in size, and special actuating elements, such as knobs and buttons, and displays are required for programming cooking processes.

The invention has been made to resolve above-mentioned problems, and its object is to provide a computerized cooking device in which can automatically control and cook various types of cuisine either through the hot air, steam or hot oil. The present invention provides an automatic cooking device that can cook food, such as stir-fry dish, with consistent and acute cooking parameters to provide consistent good taste and flavour of food without lengthy and complicate operations.

SUMMARY OF THE INVENTION

It is an object of the present invention to provide an automatic cooking device, that is simple to use and cost effective yet imparts meals cooked therein with the taste and flavour of food cooked traditionally in the conventional cooking devices.

Another object of the present invention is to provide for an automatic cooking device which can be used to cook various meals and preparations conveniently without impairing in quality of taste and flavour of the meals.

A further object of the present invention is to provide for a cooking device which can be easily moved and transported.

The automatic cooking device of the present invention comprises a fixed structure, a rotating body and a cooking vessel, wherein the fixed structure has at least one fixed bar, and the plurality of fixed bars can be arranged vertically or horizontally or at a slant angle. The rotating body has a first rotating device, a first device, a second rotating device and a third rotating device, wherein the rotating body is connected to the fixed structure to perform 3-dimensional movement. The cooking vessel is connected onto one side of the rotating body in which another side of the rotating body is connected to the fixed structure in such that the rotating body initiates the cooking vessel to operate the 3-dimensional movement. A first driving motor is provided at one end of the first rotating device connected to the fixed structure, and the first device is connected to one side of the first rotating device in which its opposite side of the first rotating device is connected to the fixed structure such that the first device is driven by the first driving motor to swing. The second rotating device is connected to one side of the first device to interact with the first device, and the third rotating device is positioned at one side of the second rotating device which is opposite to the connection side of the second rotating device and the first device in order to interact with the second rotating device.

Both the forgoing general description and the following detailed description are exemplary and explanatory only and are not restrictive of the invention, as claimed.

BRIEF DESCRIPTION OF THE DRAWINGS

The accompanying drawings are included to provide a further understanding of the present invention, and are incorporated in and constitute a part of this specification. The drawings illustrate embodiments of the present invention and, together with the description, serve to explain the principles of the invention. In the drawings.

DESCRIPTION OF THE PREFERRED EMBODIMENTS

Figure 1:
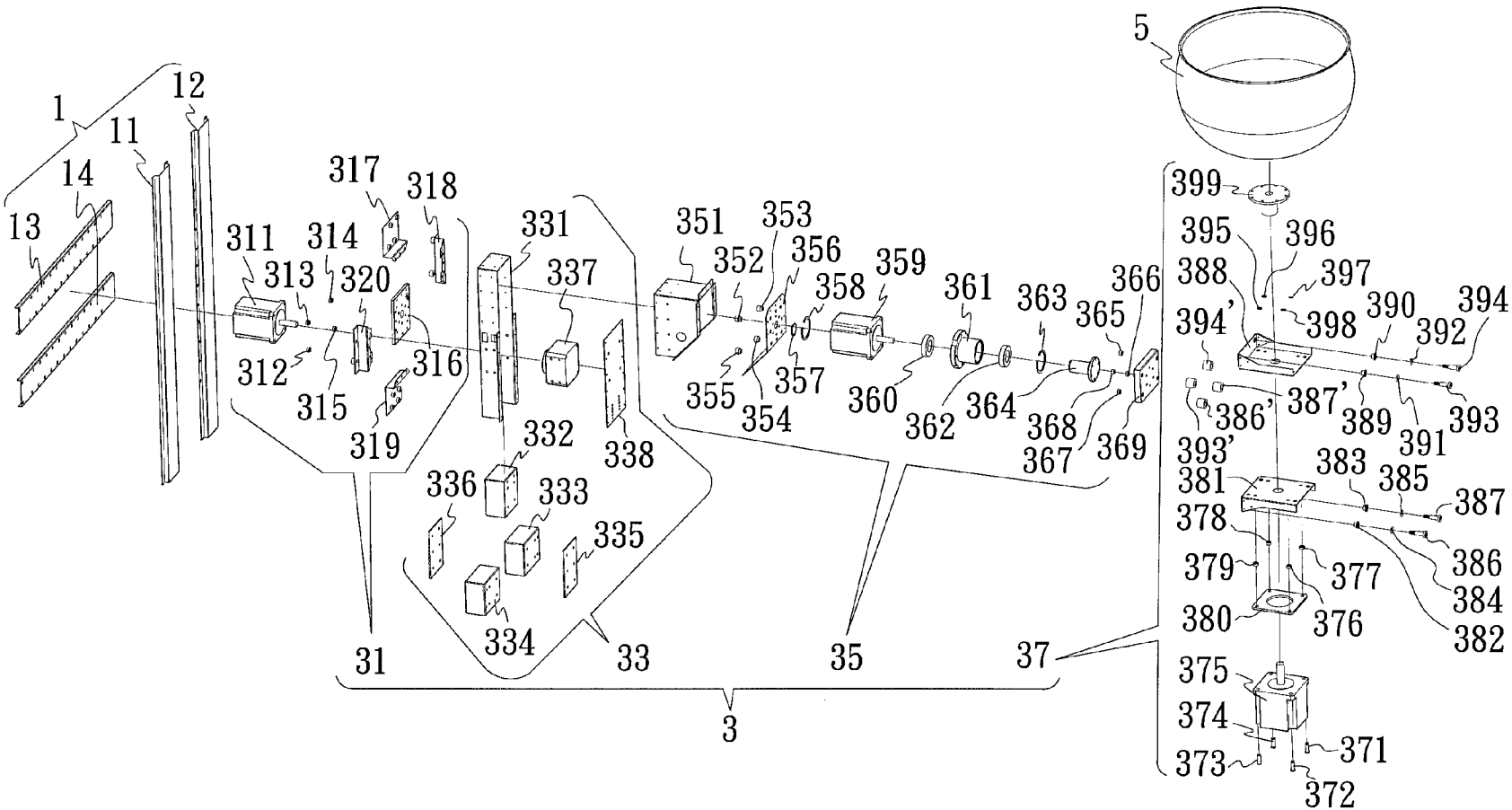
FIG. 1 is an assembly view of an automatic cooking device in accordance with a prefer example of the present invention.
Figure 2:
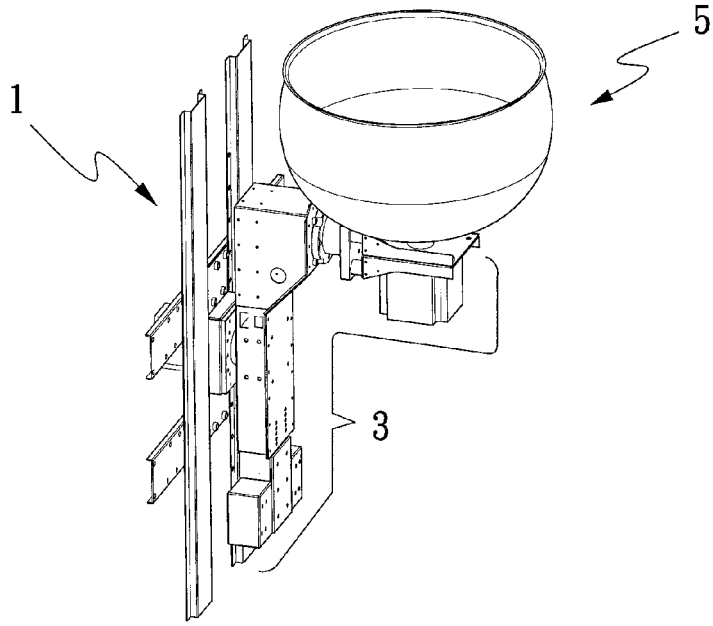
FIG. 2 is a 3 dimensional view of the assembled automatic cooking device in accordance with a preferred example of the present invention.
Figure 3:
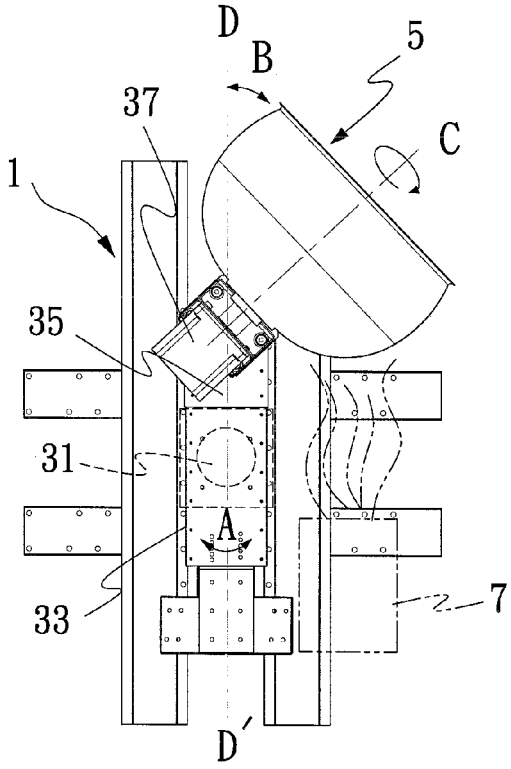
FIG. 3 is a front-view of the assembled automatic cooking device by showing how the assembled automatic cooking device can be operated in accordance with a preferred example of the present invention.

FIG. 1 illustrates an assembly view of an automatic cooking device in accordance with a prefer example of the present invention. The present invention provides an automatic cooking device with an embedded control for regulating cooking process, wherein the automatic cooking device comprises a fixed structure 1 with four fixed bars 11-14. In a preferred embodiment, the fixed bars, such as 11 and 12, are arranged vertically, and the fixed bars 13 and 14 can be arranged horizontally to the fixed bars 11 and 12 as shown in FIGS. 2 and 3, but other arrangements between the fixed bars 11-14 can be laid, such as the fixed bars 13 and 14 are arranged at a slant angle to the fixed bars 11 and 12, or perpendicularly to each other to form a square-shaped structure. Accordingly, the arrangements between the fixed bars 11-14 are not limited or restricted to the above-mentioned arrangements.

The automatic cooking device further comprises a rotating body 3 and a cooking vessel 5, wherein the rotating body 3 is utilized to integrate with the cooking vessel 5 with the fixed structure 1 by mounting the cooking vessel 5 onto a top portion of the rotating body 3 to perform 3-dimensional motion, the movement of the automatic device includes vibration, motions, rotating, swinging or a combination of any two different motions. The rotating body 3 comprises a first rotating device 31 attaching onto the fixed structure 1, a first fixed device 33 and a second rotating device 35. The first rotating device 31 further comprises a first driving motor 311, a plurality of attaching rings 312, 313, 314 and 315, and a plurality of attaching plates, wherein the attaching plates include an attaching plate 316, an upper plate 317, a right plate 318, a bottom plate 319 and a left plate 320.

The first device 33 is connected to an opposite side to a connection between the first rotating device 31 and the fixed bars 11-14 of the fixed structure 1 in such that the first device 33 is driven by the first rotating device to rotate and vibrate. The first device 33 comprises a first connecting unit 331 and a plurality of fixed units, wherein the fixed units further divided into an upper fixed unit 332, a right fixed unit 333 and a left fixed unit 334. A plurality of fixed plates, such as a fixed plate 338, a front fixed plate 335 and a rear fixed plate 336, are provided to integrate with the fixed units 332-334, wherein an integrating unit 337, such as a gear shifting box, is provided to interact with the first driving motor 311. A second rotating device 35 is provided to integrate with the first device 33 and the first rotating device 31 on the fixed structure 1, wherein the second rotating device 35 comprises a second connecting unit 351, a plurality of fixing units 352-355, a plurality of fixed plates 356 and 369, an O-ring unit 357, and a plurality of connecting rings 358 and 363. A second driving motor 359, a plurality of bearings 360 and 362, a plurality of caps 361 and 364, and a plurality of fixing units 365-368 are also provided in the second rotating device 35.

A third rotating device 37 is utilized to position the cooking vessel 5 with the second rotating device 35 and the first device 33 such that the third rotating device 37 can move or rotate corresponding to the second rotating device 35. The third rotating device 37 comprises a plurality of fixing units, 371-374, 382,386-387, 389 and 393-394, a third driving motor 375, a connecting plate 380, a plurality of screw caps 376-379,383, 389,390, 395-398, a plurality of connecting plates 381 and 388, a plurality of O-ring units 384, 385, 391 and 392, and a plurality of sleeves 386'. 387', 393', 394' and 399. The cooking vessel 5 is positioned on the third rotating device 37 in such that the cooking vessel is rotated corresponding to the movement of the combination between the second rotating device 35 and the first device 33.

FIG. 2 illustrates a 3-D view of the assembled automatic cooking device in accordance with a preferred example of the present invention. The cooking vessel 5 is integrated with the rotating body 3 and the fixed structure 1.

FIG. 3 shows a front-view to demonstrate how the assembled automatic cooking device can be operated in accordance with a preferred example of the present invention. Refer to FIG. 3, once the ingredients are placed in the cooking vessel 5, the first device 33 of the rotating body 3 rotates along a central axis D-D' of the automatic cooking device. In other words, the first device 33 of the rotating body 3 swings along a direction A in such that the second rotating device 35 of the rotating body 3 is interacted with the first rotating device 31 and the first device 33 to move along the direction A. The third rotating device 37 swings along a direction B as shown in FIG. 3 so that the third rotating device 37 of the rotating body 3 is interacted with the second rotating device 35. The cooking vessel 5 is then rotated in a rotation direction C in such that the ingredients within the cooking vessel can be mixed up and heated up or cooked up through a heater 7.

The automatic cooking device of the present invention is designed in such to manage complex cooking processes or food preparation, the food can be prepared either through hot oil, such as stir-fry, or hot air or steam. The automatic cooking device of the present invention utilizes a computerized cooking program to control and manage various temperatures and different cooking time settings for different types of food, therefore, the ingredients are properly controlled through the cooking program in order to provide consistent flavor and good quality taste of food. Further, the amount of the food to be prepared can be controlled actuarially through the automatic cooking device, thus it is simple to operate and control without requiring specific skill or knowledge. The automatic cooking device that is cost effective can be moved and transported easily form place to place. Thus, it can be operated by most of people without much difficulty.

Furthermore, the present invention can be utilized with computer program to regulate and control the cooking processes of the food, and store the data of the particular taste and flavor of every meal. In other words, the data base of the computerized program can record the information of specific meals with particular ingredients for particular customer, when the consumer go to one of food-chain restaurants utilizing the automatic cooking device, he or she still can get the specific flavor and taste of the meals no matter where she or he is.

Moreover, the automatic cooking device can be incorporated with computer and Internet service such that customers can order their favor food with exact quality of taste easily from their own homes.

Other embodiments of the invention will appear to those skilled in the art from consideration of the specification and practice of the invention disclosed herein. It is intended that the specification and examples to be considered as exemplary only, with a true scope and spirit of the invention being indicated by the following claims.

What is claimed is:

1. An automatic cooking device, comprising a fixed structure, having at least one fixed bar, wherein the plurality of fixed bars can be arranged vertically or horizontally or at a slant angle, a rotating body, having a first rotating device, a first device, a second rotating device and a third rotating device, wherein the rotating body is connected to the fixed structure to perform 3-dimensional movement; and a cooking vessel, wherein the cooking vessel is connected onto a top side portion of the rotating body, and further wherein an end of the first rotating device of the rotating body is connected to the fixed structure in such that the rotating body initiates the cooking vessel to operate the 3-dimensional movement, wherein a first driving motor is provided at one end of the first rotating device connected to the fixed structure, the first device is connected to the opposite end of the first rotating device away from and opposite to the other end of the first rotating device where the drive motor is connected, so that the first rotating device is located between the fixed structure and the first device, such that the first device is driven by the first driving motor of the first rotating device to swing the first device, the second rotating device is connected to a location of the first device that is spaced away from the separate location of the first device that is connected to the first rotating device, thereby allowing the second rotating device to interact with the first device independent from the first rotating device, the third rotating device is positioned at one side of the second rotating device which is opposite to the connection side of the second rotating device and the first device in order to interact with the second rotating device.

2. The automatic cooking device of claim 1, wherein the first rotating device further comprises a plurality of attaching rings and a plurality of attaching plates the plurality of attaching rings and the plurality of attaching plates formed and located to facilitate operable assembly connection of the first rotating device to the first device.

3. The automatic cooking device of claim 1, wherein the first device further includes a first connecting unit, at least one integrating unit, a plurality of fixed units, and fixed plates the first connecting unit, at least one integrating unit, plurality of fixing units, and fixed plates being formed and located to facilitate operable assembly connection of the first device to the first rotating device and the second rotating device.

4. The automatic cooking device of claim 1, wherein the second rotating device further comprises a second connecting unit, a plurality of fixing units, a plurality of fixed plates, at least one O-ring unit, and a plurality of connecting rings, a second driving motor, a plurality of bearings, a plurality of caps, and a plurality of fixing units, the second connecting unit, plurality of fixing units, plurality of fixed plates, at least one O-ring unit, and the plurality of connecting rings, second driving motor, plurality of bearings, plurality of caps, and plurality of fixing units, being formed and located to facilitate operable assembly connection of the second rotating device to the first device and the third rotating device and the cooking vessel.

5. The automatic cooking device of claim 1, wherein the third rotating device comprises a plurality of fixing units, a third driving motor, at least one connecting plate, a plurality of screw caps, a plurality of connecting plates, a plurality of O-ring units, and a plurality of sleeves, the plurality of fixing units, third driving motor, at least one connecting plate, plurality of screw caps, plurality of connecting plates, plurality of O-ring units, and plurality of sleeves, being formed and located to facilitate operable assembly connection of the third rotating device to the second rotating device.

6. The automatic cooking device of claim 1, wherein the 3-dimensional movement can include rotation, vibration, swinging or any one of those motions.

7. The automatic cooking device of claim 1, wherein the 3-dimensional movement includes rotation, vibration, swinging or any two of these motions.

8. The automatic cooking device of claim 1, wherein the 3-dimensional movement includes rotation, vibration, swinging or a combination of any two of these motions simultaneously.

* * * * *